United States Patent [19]

Nakamura

[11] Patent Number: 4,651,940

[45] Date of Patent: Mar. 24, 1987

[54] SCREEN-TAKING-UP DEVICE

[75] Inventor: Daijiro Nakamura, Ono, Japan

[73] Assignee: SM Industrial Co., Ltd., Osaka, Japan

[21] Appl. No.: 758,348

[22] Filed: Jul. 24, 1985

[30] Foreign Application Priority Data

Nov. 6, 1984 [JP] Japan ..... 59-234775

[51] Int. Cl.[4] ..... E06B 9/204; B65H 75/30

[52] U.S. Cl. ..... 242/55; 160/310

[58] Field of Search ..... 242/55, 67.1 R; 160/310, 312, 291; 254/339

[56] References Cited

U.S. PATENT DOCUMENTS

| | | | |
|---|---|---|---|
| 1,742,094 | 12/1929 | Perks et al. | 160/310 |
| 2,828,429 | 3/1958 | Creonti | 160/310 X |
| 4,172,563 | 10/1979 | Werner et al. | 242/55 |
| 4,372,367 | 2/1983 | Baldanello et al. | 242/55 X |

FOREIGN PATENT DOCUMENTS

| | | | |
|---|---|---|---|
| 386247 | 5/1922 | Fed. Rep. of Germany | 254/362 |
| 2411295 | 8/1979 | France | 160/310 |

*Primary Examiner*—Stuart S. Levy
*Assistant Examiner*—Joseph J. Hail, III
*Attorney, Agent, or Firm*—Moonray Kojima

[57] ABSTRACT

The present invention relates to a screen take-up device characterized in that the output from the normal-reverse turn motor of outer-rotor type contained in a screen take-up shaft is transmitted to the take-up shaft after being reduced in speed; brake is applied by a braking mechanism on the inertia output from the motor in sync with the stopping of the aforementioned motor; the number of revolutions of the take-up shaft is counted by a counter and the motor is controlled to stop at the preset number of revolutions; and the output from the manual shaft which is manually rotated in normal-reverse way is transmitted to the take-up shaft through a self-locking mechanism after being reduced in speed.

5 Claims, 12 Drawing Figures

SCREEN-TAKING-UP DEVICE

BACKGROUND OF THE INVENTION

The present invention relates to a screen taking-up device for taking up and unrolling a screen—any of various types, e.g., curtains, blinds, light weight shutters, tents, movie screens, etc.—which is done by driving its take-up shaft in the normal and reverse directions.

When taking up or unrolling the screen wound on the aforementioned take-up shaft by the driving force of a motor, this operation is simplified, if the screen is automatically stopped at a specified taken-up position or an unrolled position merely by a single operation of a motor driving switch.

The stopping of the screen at a specified position as above-described is made possible by providing a positioning mechanism for controlling the motor to stop, as the amount of movement of the screen is found to have reached the value preset for making the stop, as counted by a counter, for example.

If the inertial output of the motor acts on the screen, however, the screen does not stop at the preset stop position, but it overruns the stop position, making it impossible to have correct stop position, even if the motor is controlled to stop, when the screen is being unrolled, for example.

On the other hand, a method considered effective for eliminating the inertial output of the motor is that with an electromagnetic brake provided on the output side of the motor, brake is applied on the inertial output by switching this electromagnetic brake on in sync with the stop control timing of the motor.

However, this condition involves the problem of power consumption increase, because the electromagnetic brake must be energized while the screen is stopped at the taken-up position or the unrolled position.

Another problem is that even with a construction adapted for operation of the screen by the driving force of a motor, as above-described, if the device is so composed as to permit the operation of the screen in manual way, the operation of the screen is interrupted or operation of small amount of taking-up-unrolling of the screen is desired to make, but if the manual output is simply connected to the take-up shaft, the motor is rotated by this manual output, thus interfering with the revolution of the take-up shaft.

OBJECT OF THE INVENTION

A first object of this invention is to provide a small-sized screen taking-up device by forming in a cylindrical shape a take-up shaft on which a screen is wound, to house a motor of outer-rotor type inside this take-up shaft.

A second object is to provide a screen taking-up device which ensures stopping of the screen at the preset stop position by use of a braking mechanism which operates in sync with the stop control timing of the motor.

A third object is to provide a screen taking-up device which permits positive braking to be applied with a minimum power consumption.

A fourth object is to provide a screen taking-up device which affords both automatic and manual operations, the latter being simplified.

BRIEF DESCRIPTION OF THE DRAWINGS

The accompanying drawings show an embodiment of this invention, of which.

EMBODIMENT OF THE INVENTION

An embodiment of this invention is described in detail with reference to the accompanying drawings:

The accompanying drawings show a taking-up device for a roll blind for providing screening from the sun and lights, as an example of the screen taking-up device.

Figure 1:
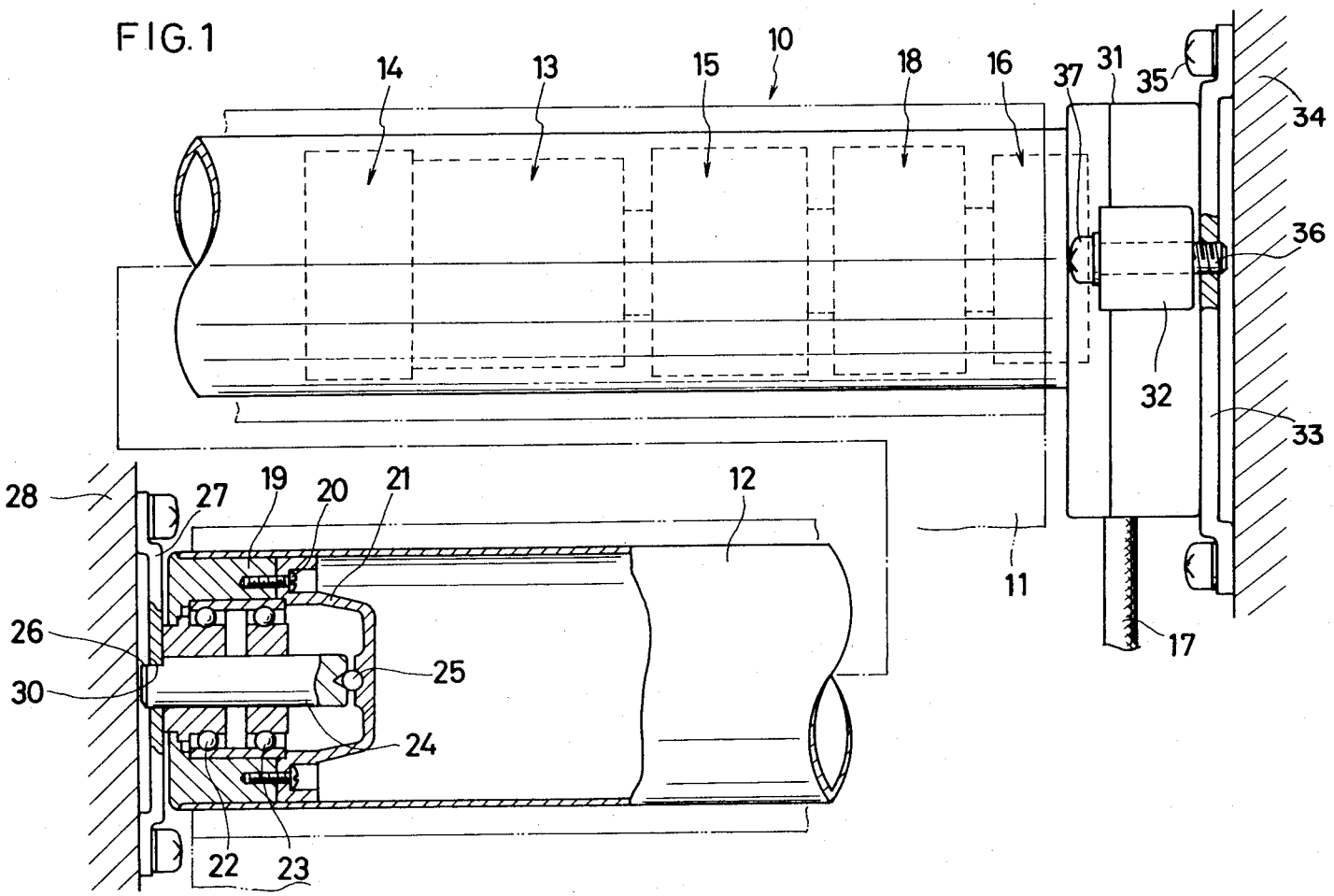
FIG. 1 is a partly broken side view in section of a blind taking-up device.

Referring to FIG. 1, the taking-up device 10 for a roll blind is equipped with:

a take-up shaft 12 for taking up or unrolling a blind 11 one end of which is fixed on the peripheral surface of the shaft, a drive 13 for driving this take-up shaft 12, a braking mechanism 14 for applying brake on the inertial output, as the drive 13 has come under stop control, a motor side reduction mechanism 15 for reducing in speed the output from the drive 13 and, then, transmitting this reduced output to the take-up shaft 12, a positioning mechanism 16 for subjecting the drive 13 to stop control, with the stop position of the blind 11 preset on the basis of the number of revolutions of the take-up shaft 12, and a manual side reduction mechanism 18 for reducing in speed the output from the manual operation shaft later described which is rotated normally or reversely by the manual turning operation with a rope 17 and, then, transmitting this reduced output to the motor side reduction mechanism 15.

At respective both ends of the above-described take-up shaft 12, constructions for mounting this taking-up device 10 are composed.

Thus on the take-up shaft 12, a cylindrical member 19 and a bottomed support member 21 attached to this cylindrical member 19 with screws 20 are fitted and fixed at one end thereof and in the cylindrical member 19, two bearings 22 and 23 are inserted in parallel with each other.

On the bearings 22 and 23, a support shaft 24 is rotatably borne and between the inner end of this support shaft 24 and the part of the support member 21 facing this inner end a ball is interposed to bear the stress exerted inwards by the support shaft 24.

The outer end of the support shaft 24 is partly notched in a semicircular shape, said notched part 26 providing a structure effective for detaining the support shaft 24 from rotation.

The bracket 27 for mounting the support shaft 24 is fixed by means of screws 29, 29 on the fixing part 28 of the wall or pillar adapted for mounting the taking-up device 10; at the center of this bracket 27, a hole 30 mated to the notched shaft end part 26 formed at the outer end of the support shaft 24 is formed and the take-up shaft 12 is mounted on the bracket on one end side thereof with the end of the support shaft 24 inserted into this mating hole 30.

On the other end side of the take-up shaft 12, a housing 31 which is supporting this take-up shaft 12 in the state of permitting its rotation is installed contiguously thereto and on both right and left sides of this housing 31, lugs 32 for its mounting are provided contiguously thereto.

A bracket 33 for attaching the lugs 32 of the aforementioned housing 31 is fixed with screws 35, 35 on the fixing part 34 of the wall or pillar on which to mount the taking-up device 10 and in the parts of this bracket 33 facing the lugs 32, screw holes 36 are formed; then, screws 37 inserted through the lugs 32 are screwed into these screw holes 36, whereby the take-up shaft 12 is mounted on the fixing part 34 on the other end side thereof.

As hereabove described, this taking-up device 10 is mounted on the right and left brackets 27 and 33 and thereby supported at the both ends thereof.

(2) DESCRIPTION OF DRIVE

Figure 2:
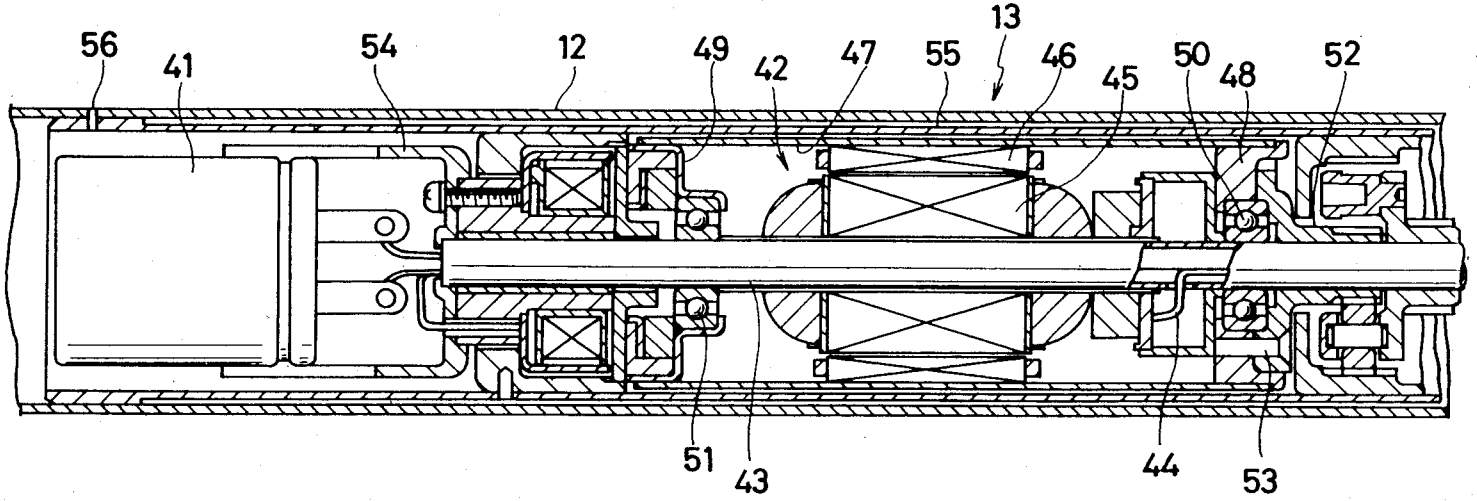
FIG. 2 is a side view in section of its drive.

As shown in FIG. 2, the drive 13 has its drive source composed of a condenser motor 42 which is operated by a condenser 41 for operation, said condenser motor 42 being of outer rotor type which is subjected to normal reverse turn control.

In the drive 13, there is inserted at its center a support shaft 43 with its root end fixed in the housing 31, said support shaft 43 being formed hollow, and in this hollow part, the wiring for supplying power to the condenser motor 42 is housed.

The condenser motor 42 is composed of a stator 45 and an outer rotor 46, said stator being fixed on the support shaft 43.

On the outer circumferential surface of the outer rotor 46, a cylinder 47 is fitted and secured for rotation integrally therewith and into both ends of this cylinder 47, annular support members 48 and 49 respectively securely coupled, which are borne by the support shaft 43 through bearings 50 and 51.

On the outside surface of the support member 48 on one side, an output gear 52 is fixed by means of a screw 53, so that the turning force of the condenser motor 42 be delivered through this output gear 52.

On the inner end of the support shaft 43, a cup shape holder 54 is fixed and on the opening side of the inner end of this holder 54, the condenser 41 for operation is held.

The drive 13 composed as hereabove described is housed in an external cylinder 55 and in this external cylinder 55, the brake mechanism 14, motor side reduction mechanism 15 and manual side reduction mechanism 18 are also housed.

And the external cylinder 55 is rotated by the turning force of the drive 13 through the motor side reduction mechanism 15 which is described later and, further, this turning force drives the take-up shaft 12, with the inner end of the external cylinder 55 coupled to the take-up shaft 12 by a pin 56.

It should be noted that the turning direction of the condenser motor 42 and that of the aforementioned external cylinder 55 are opposite to each other due to the interposition of the motor side reduction mechanism 15.

DESCRIPTION OF BRAKE MECHANISM

Figure 3:
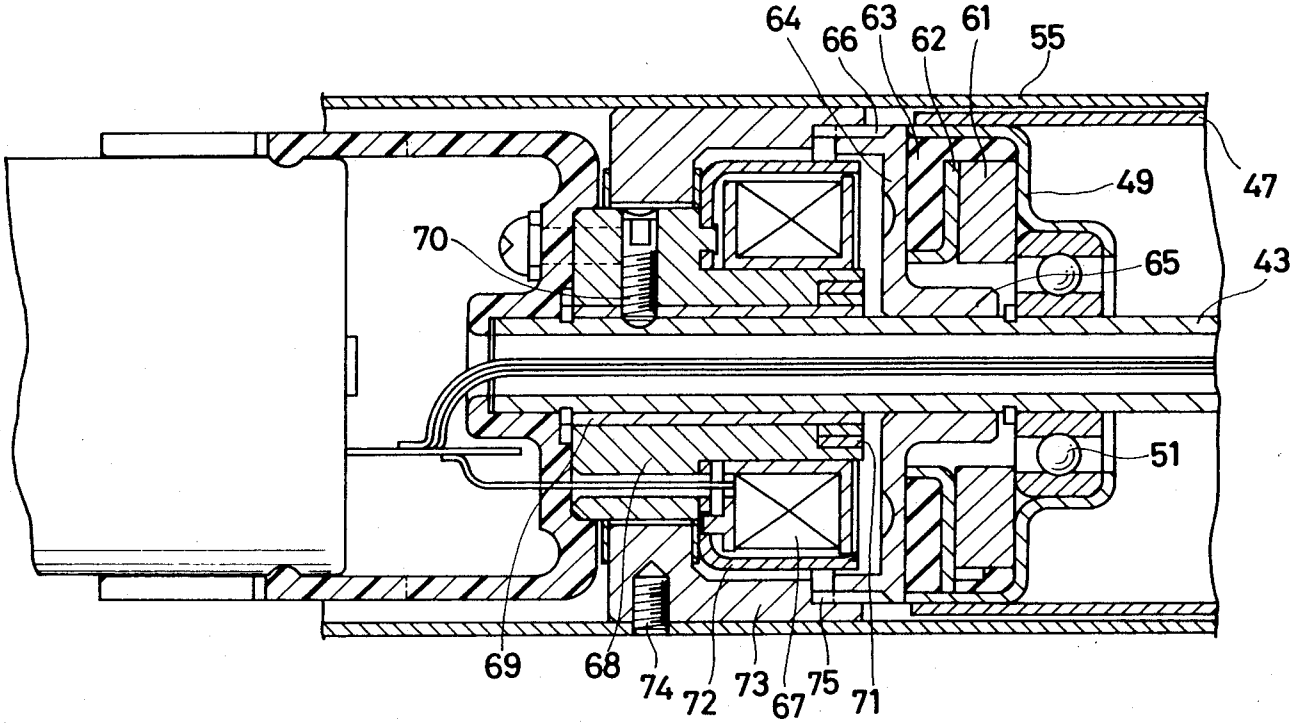
FIG. 3 is a side view in section of its brake mechanism.

As shown in FIGS. 2 and 3, the braking mechanism 14 is composed as follows:

Thus the support member 49 which composes part of the drive 13 is formed of a magnetic member cylindrical in shape; in the interior of the cylinder of this support member 49, a permanent magnet 61 formed annular in shape which has a specified magnetic force is housed; a center yoke 62 formed of a magnetic member annular in shape is joined to the outside of this permanent magnet 61; between this center yoke 62 and the support member 49, a wear resistant abutting member 63 like a brake lining is fitted, whereby not only the support member 49, center yoke 62 and the abutting member 63 are integrated, but their outside surfaces are formed flush with each other.

At a position outside the center yoke 62, a brake plate 64 formed of a magnetic body annular in shape is placed facing it, the boss 65 of said brake plate 64 being fitted on the support shaft 43 with a play to allow some amount of sliding thereon in the axial direction, and further, a spline 66 is cut on the external peripheral rim of the brake plate 64.

And when the brake plate 64 has moved to the side of the permanent magnet 61, a magnetic circuit is formed by the center yoke 62, brake plate 64, support member 49 and the permanent magnet 61, whereby the brake plate 64 is attracted to the permanent magnet 61 side.

At a position outside the brake plate 64, an electromagnet 67 is placed facing it at a distance equal to the amount of movement preset for this brake plate 64, said electromagnet 67 being formed annular in shape and pressed along and fixed to one end of a center yoke 68, said center yoke 68 not only being fitted on the support shaft 43 through a sleeve 69, but also fixed to the support shaft 43 with a screw 70.

In the part of the center yoke 68 facing the brake plate 64, a ring 71 for prevention of shifting of the moving magnetic field is fitted.

On the external periphery of the electromagnet 67, an external peripheral yoke 72 formed of a magnetic body cylindrical in shape is fitted, said external peripheral yoke 72 being fixed to the center yoke 68 at the inner end thereof.

And the electromagnet 67 is so preset that it has a magnetic force larger than that of the permanent magnet 61, when the magnetic force is generated by its excitation, wherefore as the brake plate 64 has moved to the side of the electromagnet 67, a magnetic circuit is formed by the center yoke 68, brake plate 64, external peripheral yoke 72 and the electromagnet 67 and consequently, the brake plate 64 is attracted to the side of the electromagnet 67.

On the external peripheral part of the external peripheral yoke 72, an annular body 73 formed cylindrical in shape is located, said annular body 73 being fixed to the external cylinder 55 by means of a screw 74, for it to rotate, interlocked with the rotation of the external cylinder 55.

On the internal peripheral surface of the annular body 73 on the side of the brake plate 64, a spline 75 normally mated with the spline 66 of the brake plate 64 is cut. With their mutual splines 66 and 75 thus mated with each other, the brake plate 64 makes rotation, interlocked with the rotation of the annular body 73, irrespective of its movement in the axial direction.

In the brake mechanism 14 composed as hereabove-described, synchronized with the switching-ON-OFF of the condenser motor 42 of the drive 13, the electromagnet 67 is subjected to ON-OFF control, so that while the condenser motor 42 and the electromagnet are both OFF, the brake plate 64 be being attracted to the side of the permanent magnet 61.

As hereabove described, since the condenser motor 42 and the external cylinder 55 turn in mutually opposite directions due to the interposition of the motor side reduction mechanism 15, the permanent magnet 61 side interlocked with the condenser motor 42 and the brake plate 64 interlocked with the external cylinder 55 rotate in mutually opposite directions.

Therefore, as the brake plate 64 is attracted by the permanent magnet 61, brake is applied on the mutual rotations of the abutting member 63 and the brake plate 64 by the frictional resistance of the abutting member 63 and the rotation of the condenser motor 42 is, therefore, in its locked state.

As the drive 13 is brought into operation, with the condenser motor 42 switched on, the electromagnet 67 is switched on, to be excited, in sync with this start-up.

Due to this excitation, the brake plate 64 is attracted to the side of the electromagnet 67, departing from the abutting member 63; as a result, the rotation of the condenser motor 42 is permitted.

Then as the condenser motor 42 is switched off, causing the drive 13 to stop, then, synchronized with this stop, the electromagnet is switched off, to be demagnetized and, as a result, its attraction of the brake plate 64 is released.

As a result, the brake plate 64 is attracted to the side of the permanent magnet 61 by the magnetic force of the permanent magnet 61, then, as hereabove-described, due to the frictional resistance of the abutting member 63, brake is applied on the mutual rotations of the abutting member 63 and the brake plate 64 and, consequently, the condenser motor 42 is locked against its rotation, whereby brake is applied on the output resulting from the inertia.

DESCRIPTION OF MOTOR SIDE REDUCTION MECHANISM

Figure 4:
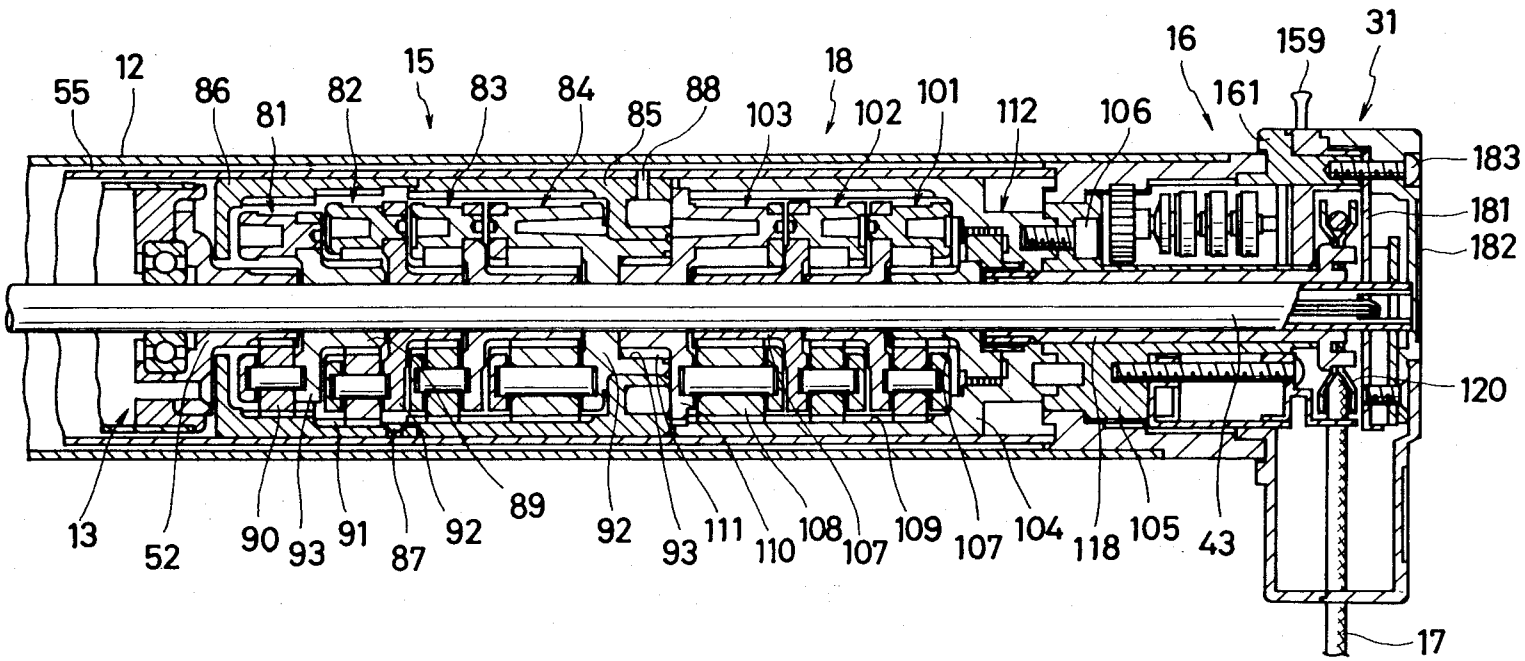
FIG. 4 is a side view in section of both motor side and manual side reduction mechanisms.

As shown in FIG. 4, the motor side reduction mechanism 15 is composed as follows:

Thus the reduction mechanism is composed of 4 stages of planetary gear reduction mechanisms 81~84, these planetary gear reduction mechanisms 81~84 are housed in the interior of the cylindrical casings 85 and 86 and these casings 85 and 86 are integrally coupled by the engagement of their hooked opening edges 87 and are further coupled with the external cylinder 55 by means of a pin 88.

Each of the planetary gear reduction mechanisms 81~84 is composed of a sun gear 89 fitted on the support shaft 43 with a play, planetary gear 90, internal gear 91 and a carrier 92.

The internal gear 91, formed on the internal peripheral surface of each of the casings 85 and 86, is meshed with each planetary gear 90, while each sun gear 89, installed contiguously to the previous stage carrier 92, meshes with each planetary gear 90 and the final stage carrier 92 has a spline 93 formed on the internal peripheral surface at its cylindrical end.

And the output gear 52 of the drive 13, which is doubled as the first stage sun gear, meshes with the first stage planetary gear 90.

In the motor side reduction mechanism 15 composed as above-described, the spline 93 of the last stage carrier 92 meshes with the manual side reduction mechanism 18 which is described later and since this manual reduction mechanism 18 is locked against its rotation unless manually rotated, the final stage carrier 92 is in its fixed state.

Accordingly, as the output gear 52 of the drive 13 is turned in the normal—reverse direction, this output is reduced in speed in respective stages of reduction mechanisms 81~84 and because the carrier 92 of the last stage reduction mechanism 84 does not rotate, by the output from this last stage planetary gear 90, the casings 85 and 86 are turned, an output reduced in speed delivered, and the external cylinder 55 turned thereby.

To be sure, as this external cylinder 55 is turned, the take-up shaft 12, being coupled with this external cylinder 55, is turned; accordingly, the blind 11 is taken up or unrolled, depending on whether this take-up shaft 12 is under normal or reverse turn control.

It should be noted that due to the interposition of the planetary gear 90, the external cylinder 55 is turned in the direction reverse to the turning direction of the output gear 52.

DESCRIPTION OF MANUAL SIDE REDUCTION MECHANISM

As shown in FIG. 4, the manual side reduction mechanism 18 is composed as follows:

Thus the reduction mechanism 18 is composed of 3 stages of planetary gear reduction mechanisms 101~103, said reduction mechanisms 101~103 being housed in the interior of a cylindrical casing 104.

The casing 104 is inserted in the interior of the external cylinder 55 in the state of being fitted with some play, permitting the rotation of this external cylinder 55; the outer end surface of the casing 104 is fixedly coupled to a cylindrical support member 105, being installed contiguous to the housing 31, is in a fixed state and, therefore, the casing 104 is also in a fixed unturning state.

Each of the aforementioned planetary gear reduction mechanisms 101~103 is composed of a sun gear 107, planetary gear 108, internal gear 109 and a carrier 110.

The internal gear 109, formed on the internal peripheral surface of the casing 104, meshes with each planetary gear 108, while each sun gear 107 which is placed contiguous with the previous stage carrier 110 meshes with each planetary gear 108 and the last stage carrier 110 has a spline 111 formed on the external peripheral surface of its cylindrical end.

With the spline 111 mated with the spline 93 formed on the last stage carrier 92 of the motor side reduction mechanism 15, the output from the manual side reduction mechanism 18 is entered into the motor side reduction mechanism 15 and while the output from the drive 13 is locked by the brake mechanism 14, the output from the manual side reduction mechanism 18 rotates the take-up shaft 12 through the motor side reduction mechanism 15 and the external cylinder 55.

Between the front-most sun gear 107 and the part of the internal wall of the casing 104 facing this sun gear 107, a self-locking mechanism 112 is composed.

The self-locking mechanism 112 is a mechanism for locking the rotation from the motor side against transmission to the manual side reduction mechanism 18, while permitting rotation by manual operation, which is composed as hereunder-described.

Figure 5:
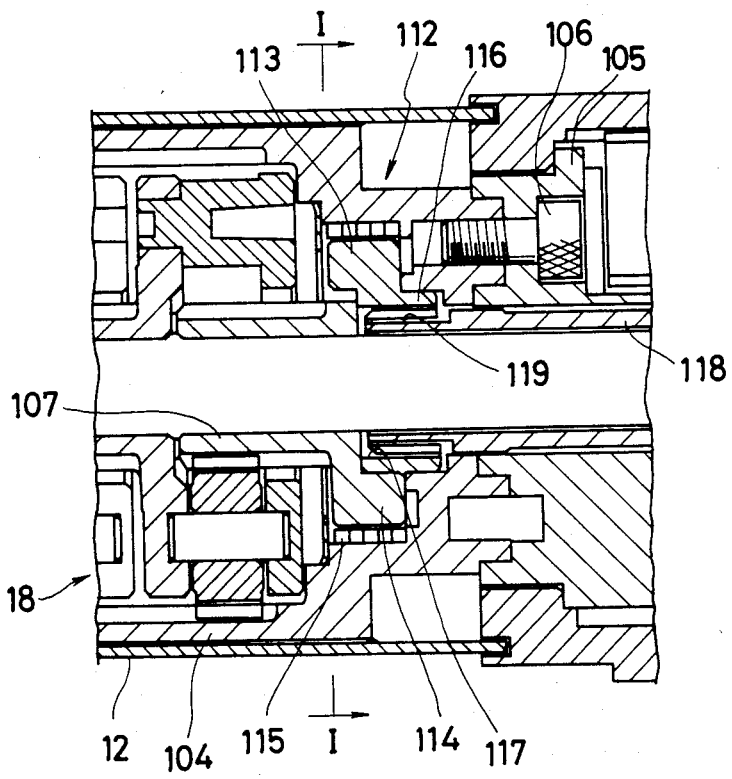
FIG. 5 is a side view in section of its self-locking mechanism.
Figure 6:
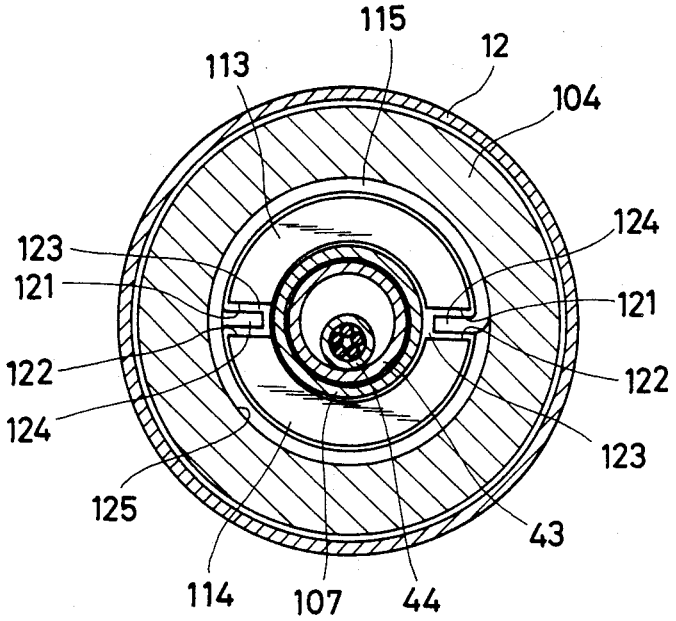
FIG. 6 is a sectional view taken along the line I—I in FIG. 5.

Thus as shown in FIGS. 5 and 6, the self-locking mechanism 112 is composed of a pair of semicircular wheels 113 and 114 being in a relation of in- and outputs and a locking spring 115.

One of the semicircular rings 113 on the output side for delivering the manual rotation has a spline 117 formed on the internal peripheral surface of its boss; with this spline 117, a spline 119 formed on the manual shaft 118 at the inner end thereof meshes; this manual shaft 118 is supported by the support shaft 43, being fitted thereon with some play; and as shown in FIG. 4, a pulley 120 is coupled with this manual shaft 118 at the outer end thereof and around this pulley 120, the rope 17 is hung.

Accordingly, by turning this rope in the normal-reverse direction, the manual rotation is transmitted to the output side semicircular ring 113 through the manual shaft 118 for the ring to rotate.

And the other semicircular ring 114 on the input side for entering the manual rotation is provided adjoining the last stage sun gear 107 of the reduction mechanism 18.

The two semicircular rings 113 and 114 are arranged on a common circle, facing each other, and between the end surfaces 121 and 122 of the respective semicircular rings 113 and 114 facing each other, a gap 123 is formed which permits with some margin entrance of both ends of the locking spring 115.

The locking spring 115 is formed in a coil shape, with both ends thereof bent inwards in the diameter direction of the circle at positions thereon opposite to each other, forming protrusions 124, 124, its OD made somewhat larger than the diameter of the cylindrical internal surface 125 or the ID of the casing 104 which houses this locking spring 115, so that when the locking spring 115 is housed inside this cylindrical internal surface 125, this cylindrical internal surface 125 is pressed thereby in contact therewith.

In inserting the protrusions 124, 124 of the aforementioned locking spring 115 in the gap 123, 123, their inserting directions are so set that when the end surface 121 of the output side semicircle 113 comes in touch with the protrusions 124, 124, to apply the turning force thereon, as its normal-reverse turn is made, the locking spring 115 is wound in, resulting in its reduced OD and consequent slippage between this locking spring 115 and the cylindrical internal surface 125.

In other words, their inserting directions are so set that when the end surface 122 of the input side semicircle 114 comes in touch with the protrusions 124, 124, thereby applying the turning force, as its normal-reverse turn is made, the locking spring 115 is wound in, resulting in expanded OD, and as a consequence, the OD of the locking spring 115 presses on the cylindrical internal peripheral surface 125 in contact therewith, thereby locking this locking spring 115 from rotation.

In the manual side reduction mechanism 18 composed as hereabove described, as the rope 17 is pulled in the normal-reverse direction, the manual shaft 118 rotates in correspondence with this rotation, thereby turning the output side semicircular ring 113, then, as the semicircular ring 113 has applied the turning force on one of the protrusions of the locking spring 115 due to this rotation, this force acts in the direction of winding in the locking spring 115 and, as a result, the locking spring 115 makes a slip on the cylindrical internal peripheral surface 125, so that the turning force of the output side semicircular ring 113 is transmitted to the input side semicircular ring 114 through the protrusion 124.

The manual turning force entered into the input side semicircular ring 114 is entered into the motor side reduction mechanism 15 through the last stage carrier 110 after being reduced in speed at the respective stages of the planetary gear reduction mechanisms 101, 102 and 103.

Accordingly, when the input side of the drive 13 of the aforementioned motor side reduction mechanism 15 is locked, the manual turning force of the manual side reduction mechanism 18 turns the casings 85 and 86 of the motor side reduction mechanism 15, thereby turning the take-up shaft 12 through the external cylinder 55.

While output is produced in the motor side reduction mechanism 15 by the operation of the drive 13, the turning force of the last stage carrier 92 of the motor side reduction mechanism 15 is given the last stage carrier 110 of the manual side reduction mechanism 18 and this turning force is applied on the input side semicircular ring 14 through the respective stages of the planetary gear reduction mechanisms 101, 102 and 103.

However, the turning force acts on the protrusion 124 of the locking spring 115 in the direction of this locking spring 115 expanding, so that the locking spring 115 presses the cylindrical internal peripheral surface 125 in contact therewith, thereby locking the rotation.

As a result, the manual side reduction mechanism 18 is in its locked state and, therefore, the outputting from the motor side reduction mechanism 15 is permitted.

DESCRIPTION OF POSITIONING MECHANISM

Figure 7:
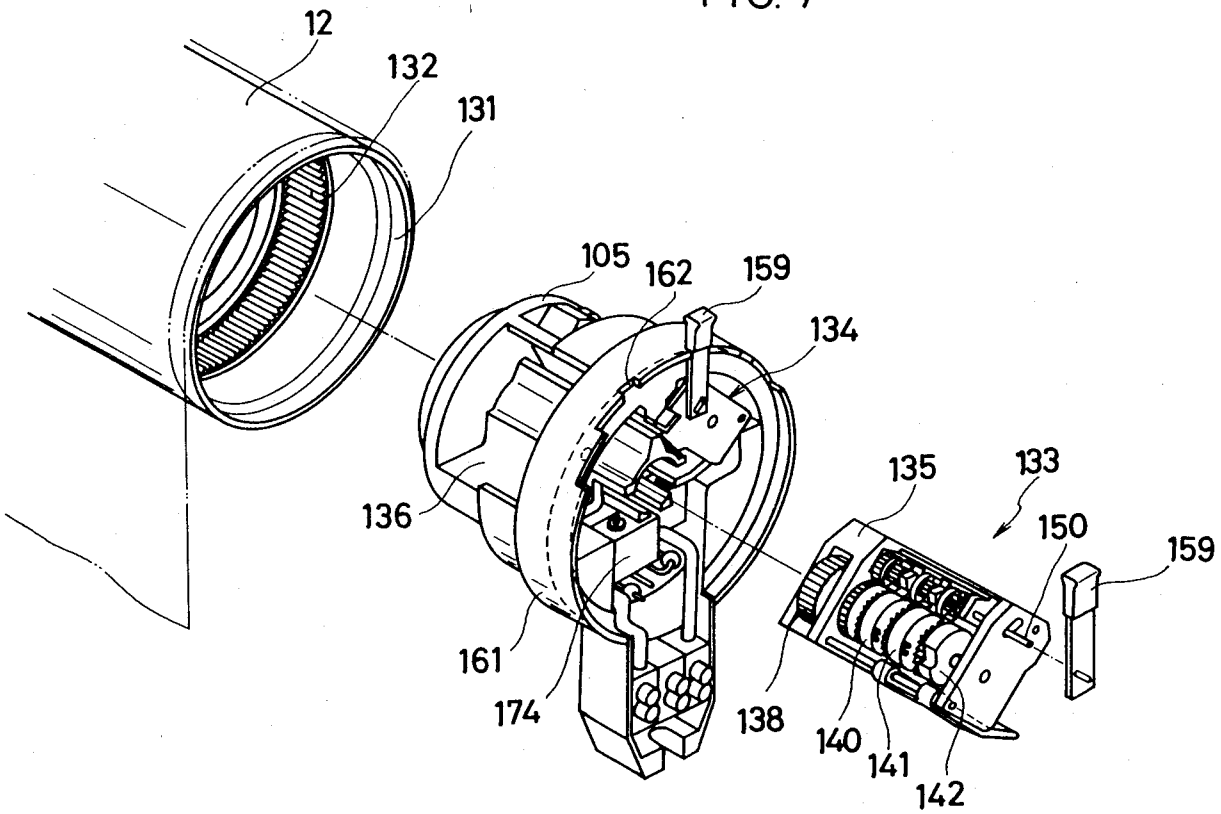
FIG. 7 is a disassembled oblique view of its positioning mechanism.

The positioning mechanism 16 is a mechanism for stopping the taking-up and the unrolling of the blind 11 at the blind taking-up upper limit position and unrolling lower limit position, which is composed as follows:

As shown in FIGS. 4 and 7, an annular body 131 is rotatably fitted on the support member 105 and on the external peripheral surface of this annular body 131, an end of the take-up shaft 12 is securely fitted; accordingly, the annular body 131 makes its rotation, interlocked with the take-up shaft 12.

On the internal wall surface of the annular body 131, an output gear 132 formed as an internal gear is cut, this output gear 132 delivers the turning force to the positioning mechanism 16.

The positioning mechanism 16 is equipped with an upper limit stop mechanism 133 for stopping the blind 11 at the taking-up upper limit and a lower limit stop mechanism 134 for stopping the blind 11 at the unrolling lower limit; these mechanisms 133 and 134 operate in correspondence with the normal-reverse turn of the drive 13 or the normal-reverse turn of the take-up shaft 12. These mechanisms themselves, however, are of an identical construction; for this reason, mainly the upper limit stop mechanism 133 is described, but detailed description of the lower limit stop mechanism 134 is omitted.

The respective upper and lower limit stop mechanisms 133 and 134 above-described are put together as a unit by means of a support frame 135 and housed in a housing 136 of the support member 105.

Figure 8:
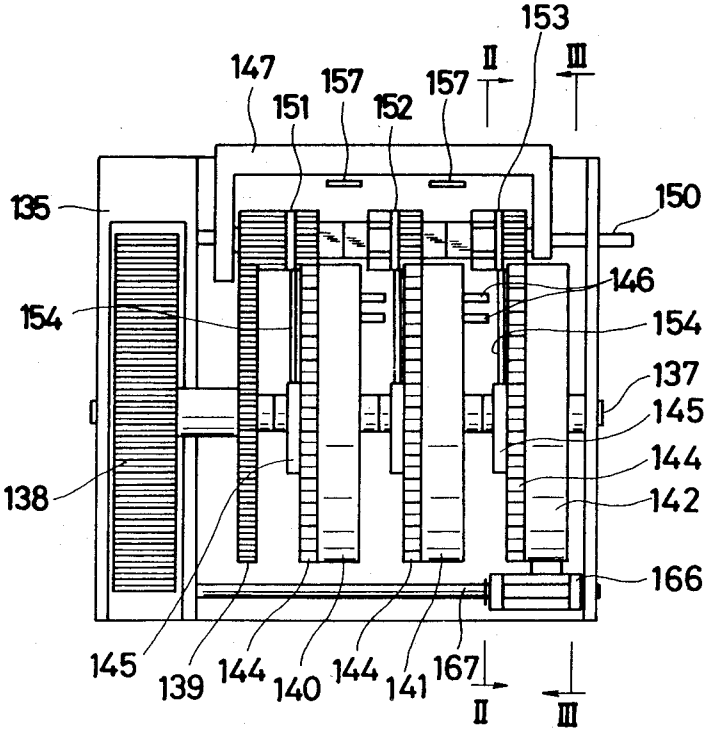
FIG. 8 is a side view of its counter.
Figure 9:
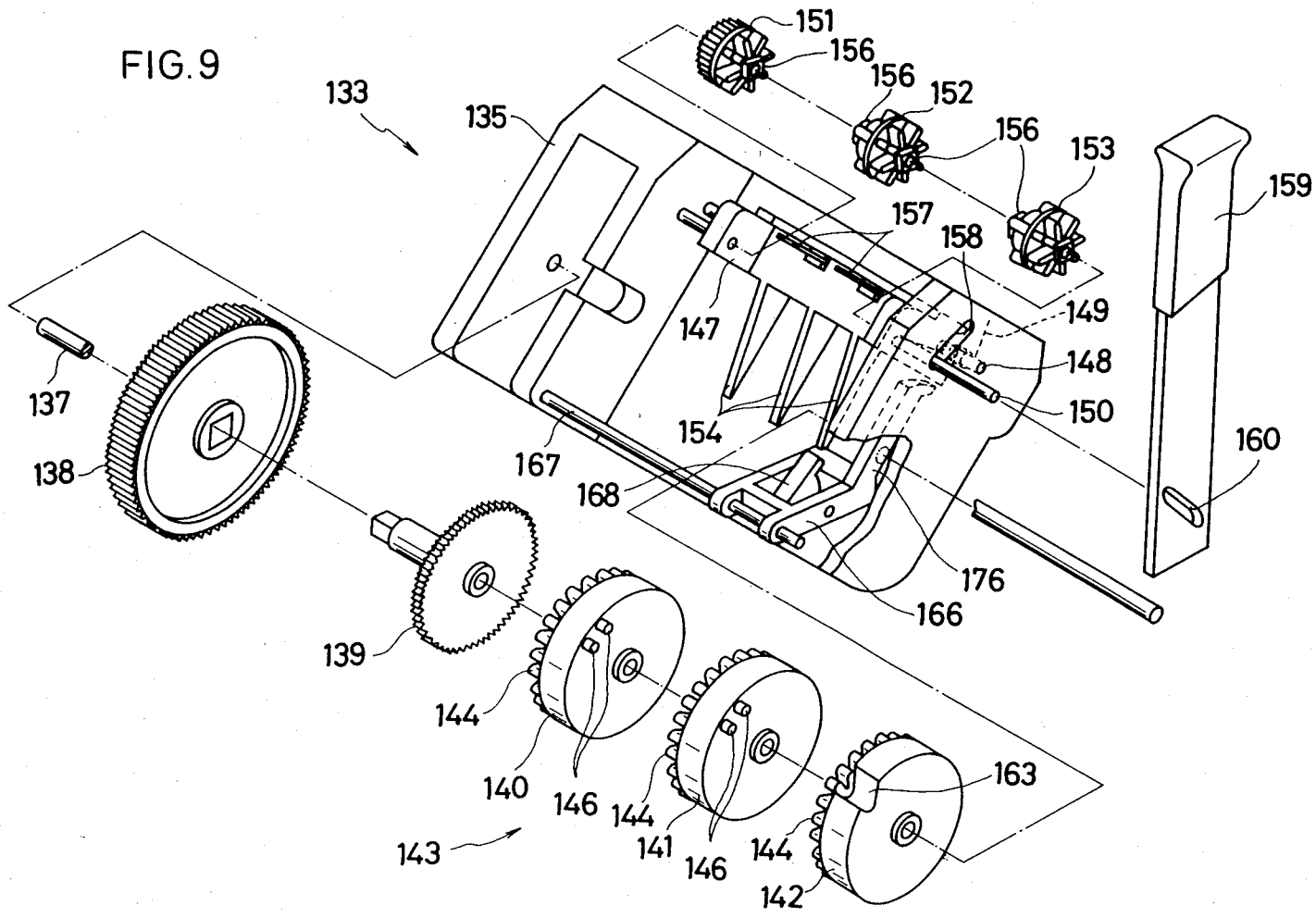
FIG. 9 is a disassembled oblique view of its counter.

As shown in FIGS. 8 and 9, on the aforementioned support frame 135, a support shaft 137 is spanned, on one end of this support shaft 137, an input gear 138 is supported with some play and with this input gear 138, an interlocking gear 139 supported on the support shaft 137 in the state of being fitted thereon with some play is coupled for integral rotation.

And the input gear 138 meshes with the output gear 132 of the aforementioned annular body 131, thereby taking the input of the normal-reverse rotation from the take-up shaft 12.

On the support shaft 137, three counter wheels 140, 141 and 142 are supported in the state of being fitted thereon with some play, said counter wheels 140~142 composing part of the counter 143.

The counter 143 counts the number of revolutions of the take-up shaft 12, so that it subjects the drive 13 to stop control, as this counted value has reached the preset value.

On one side and in the same direction of the respective counter wheels 140~142, gears 144 and heart cams 145 (refer to FIG. 10) are integrally formed therewith, said gears so operating as to turn the respective counter wheels 140~142, said heart cams operating to clear the counter and thereby restoring it to the preset initial position, as will be clearly understood by the later description.

On the other side and in the same direction of the two counter wheels 140 and 141 on the lower place side above-mentioned, shift pawls 146, 146 are formed contiguously thereto for making intermittent shifting of the counter wheels 142 and 142 respectively on the upper place side.

At a position facing the respective counter wheels 140~142, oscillating frame 147 is placed opposite thereto, said oscillating frame 147 being pivotally mounted through a shaft 148 on the support frame 135, for oscillation in the contacting and separating directions and being urged to the side of the counter wheels 140~142 by means of a spring 149 hung around the shaft 148.

On the oscillating frame 147, an oscillating shaft 150 is spanned, on this oscillating shaft 150, three carry gears 151~153 are supported in the state of being fitted thereon with some play, said carry gears facing the intermediate positions between the interlocking gear 139 and one and each two of the successive counter wheels 140~142.

The first carry gear 151 meshes with the interlocking gear 139 and the gear 144 of the first counter wheel 140, thereby transmitting the rotation of the interlocking gear 139 to the first counter wheel 140.

The second carry gear 152 meshes with the shift pawls 146 of the first counter wheel 140 and the gear 144 of the second counter wheel 141, thereby transmitting the one round turn of the first counter wheel 140 to the second counter wheel 141 as a carry amount preset therefor.

In the respective counter wheels 140~142, the number of teeth of each gear 144 and that of each carry gear 151~153 are so set that as each wheel is turned 10 rounds, the counter wheel of the next higher place is turned one round and for the counter wheel 142 of the highest place, the number of revolutions is preset so that it makes less than one turn for the amount of the maximum movement of the blind 11.

Further, while the counter wheel 140 for the lowest place makes continuous turns, counter wheels 141 and 142 of the next and the higher steps are intermittently turned by the shift turns of the shift pawls 146.

And as the counter wheel 140 of the lowest place makes one turn, based on the rotation of the take-up shaft 12, the following step carry gears 152 and 153 are turned for carrying by the shift pawls 146 of the counter wheel 140 and by the successive transmission of such rotation for carrying, respective counter wheels 140~142 are carried.

As a result, the number of revolutions on the taking-up side or the unrolling side of the take-up shaft 12 is counted by the counter wheels 140~142.

It should be understood that the counting direction of the counter 143, that is, the shifting direction of the respective counter wheels 140~142, is the direction of making addition for the movement of the blind 11 toward its stop position side; for example, if its movement is toward the lower limit stop position of the blind 11, addition or carry is made, as the blind 11 moves in the unrolling direction, and if its movement is toward the upper limit stop position, addition or carry is made, as the blind moves in the take-up direction.

The respective counter wheels 140~142 and respective carry gears 151~153 are provided with presetting mechanisms for presetting the counting state to a value, "000", for example, being the preset counting value identified with the upper and the lower limit stop positions or the lower limit stop position of the blind 11.

Figure 10:
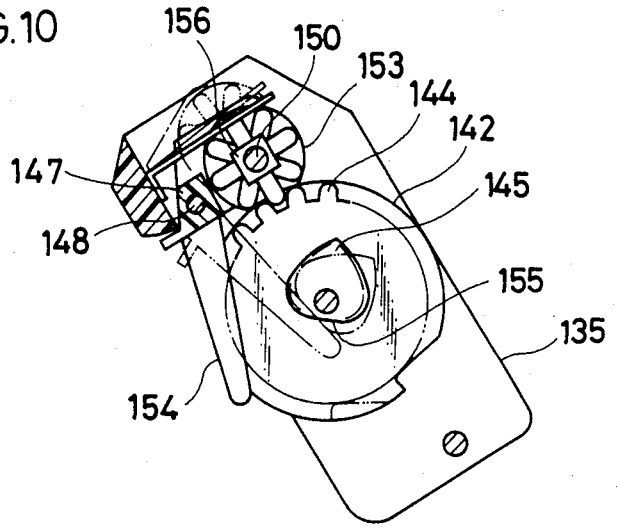
FIG. 10 is a sectional view taken along the line II—II in FIG. 8.

Thus as shown in FIG. 10, at positions of the oscillating frame 147 facing respective heart cams 145 of the respective counter wheels 140~142, set levers 154 are placed contiguous thereto, these set levers 154 not only abut on respective heart cams above-mentioned, as the oscillating frame 147 is oscillated, but make the heart cams 145 turn under the abutting pressure, so that they are always facing and in contact with these heart cams 145 at their control positions 155.

It should be understood that the control position 155 is such that two contact portions or a straight line portion which abuts on a specified range of the set lever 154 is formed and the heart cam 145 is controlled in the specified position by the abutment of the set lever 154 thereon.

And by way of turning the heart cam 145 to this specified position, the counting state of the respective counter wheels 140~142 may be set to the preset counting value or the example value "000" which is identified with their stop position (positioning).

At respective facing positions of the respective carry gears 151~153, square bosses 156 are formed contiguously thereto and facing these bosses 156, leaf springs 157 are installed, which, when the oscillating frame 147 is oscillated, abut on the plane portions of the bosses 156, thereby bringing the turning positions of the respective carry gears 151~153 into specified postures, said leaf springs 157 being fixed on the support frame 135 at their root ends.

Thus the leaf springs 157, when the oscillating operation of the oscillating frame 147 is interrupted, array the carry gears 151~153 in a state such that the teeth edges of the carry gears 151~153 and the gears 144 on the respective counter wheels 140~142 do not abut on, but mesh with each other.

On one end side, the oscillating shaft 150 of the oscillating frame 147 is extended to the outside through a long slot 158, permitting the oscillation of this oscillating shaft 150, and its end is passed through a guide slot 160 of an operation piece 159.

The operation piece 159 is in the state of being placed contiguous with the support member 105 and is vertically slidably supported in a recess 162 in the stationary member 161 which composes part of the housing 31 and the guide slot 160 causes the end of the oscillating shaft 150 to turn along this guide slot 160, when this operation piece 159 is slid upwards.

By this turning, the oscillating frame 147 is oscillated, causing the counter wheels 140~142 to be set to the set counting value.

Figure 11:
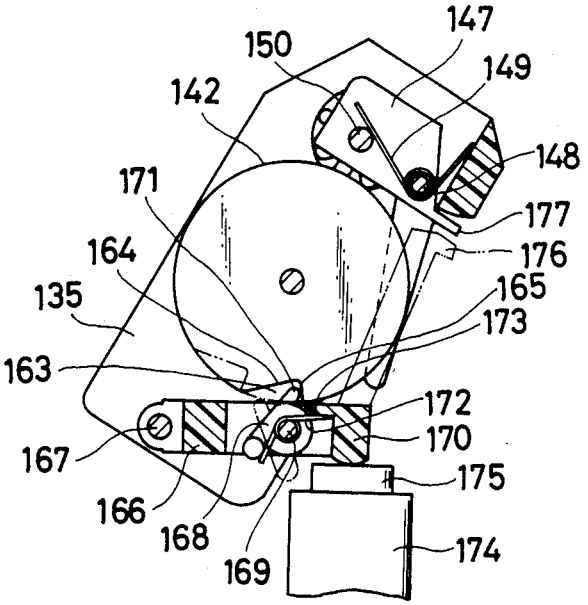
FIG. 11 is a sectional view taken along the line III—III in FIG. 8.

As shown in FIG. 11, in the peripheral surface of the highest place counter wheel 142, a recess 163 is formed, said recess being formed such that it is brought to the bottom of the counter wheel 142, as the counter 143 is set by the operation piece 159.

The recess 163 is formed to have a gradually inclined surface 164 on the upwards turning side of the counter wheel 142 and a vertical surface 165 coinciding with its radial direction on the downwards turning side.

Opposite to the counter wheel 142, a switch lever 166 is placed at its bottom position, with the root end of said switch lever 166 pivotally secured on a shaft 167 which is spanned on the support frame 135.

At the intermediate position in the switch lever 166, a rotor 168 is supported by a pin 169 as its axis and on this rotor 168, a circular surface 170 with the pin 169 as its axial center and a protrusion 171 projecting from this circular surface 170 are formed, with the amount of projection of the protrusion 171 set to be shorter than the depth of the recess 163 of the counter wheel 142.

And the rotor 168 is not only urged by a spring 172 hung around the pin 169 to have its protrusion turned toward the vertical surface 165 of the recess 163, but is controlled in position by a stopper 173.

The protrusion 171 of the rotor 168 is normally in sliding contact with the peripheral surface of the counter wheel 142, but as this counter wheel 142 turns in the preset direction and, then, the protrusion comes to face the recess 163 of the counter wheel 142, it is brought into engagement with this recess 163 and thus moves toward the side of this counter wheel 142.

Further, the protrusion 171 is so set in position that as the counter wheel 142 is set to the preset counting value by the setting operation with the operation piece 159, it is brought into engagement with the recess 163 and, thus, moves toward the side of the counter wheel 142.

Further, if the counter wheel 142 is further turned in the preset direction, the protrusion 171 is in the state of being in engagement with the recess 163 of the counter wheel 142, the protrusion 171 is phshed by the shoulder of the vertical surface 165 of the recess 163 to make a turn in defiance of the spring 172 and by this turn, the circular surface 170 of the rotor 168 is brought into sliding contact with the peripheral surface of the counter wheel 142, while the position of the switch lever 166 which is movable is kept unaltered.

The rotor 168 operates in such a way that even when the counter wheel 142 further rotates to cause the recess 163 of the counter wheel 142 to pass over the position of the protrusion 171, after the limit switch 174 has been controlled to be off by the recess 163, the limit switch 174 will not be operated to be on.

On the bottom side of the free end of the switch lever 166, the limit switch 174 is installed opposite thereto; a push button 175 of this limit switch 174 urges the switch lever 166 toward the side of the counter wheel 142.

The switch lever 166 is so placed that as the protrusion 171 of the rotor 168 has moved into engagement with the recess 163 of the counter wheel 142, the limit switch is made off due to this movement, but that when the protrusion 171 is in sliding contact with the peripheral surface of the counter wheel 142, the limit switch 174 is made on.

And the limit switch 174 effects ON-OFF control of the condenser motor 42 in the drive 13.

On the upper surface side of the free end of the switch lever 166, a lever 176 is placed extending upwards; this lever 176 faces a tongue 177 placed contiguously to the oscillating frame 147; when the oscillating frame 147 oscillates due to the setting operation, the tongue 177 depresses the top of the lever 176, thereby pressing down the switch lever 166, and upon this depression, the limit switch is made on.

The operation of the limit switch 174 based on the pressing down operation of this lever 176 lends itself to the setting operation of the counter 143.

DESCRIPTION OF OTHER APPURTENANT CONSTRUCTIONS

As shown in FIG. 4, the other end of the support shaft 43 passing through the center forks into two branches and is detained from rotation, being held by a holder 181.

The holder 181 is fixed to the fixing member 161 with a screw 183, simultaneously as the cover 182 which composes the housing 31 is fixed thereto.

The ends of the wiring 44 passed through the interior of the support shaft 43 are drawn out through the branched part, to be connected to an outside power source.

Figure 12:
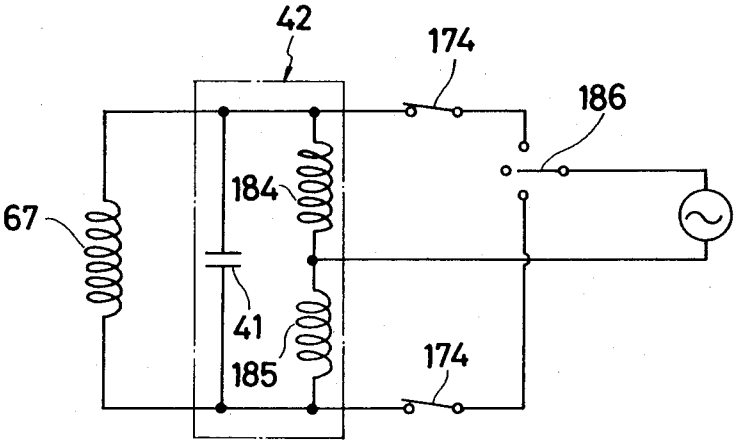
FIG. 12 is a power supply circuit diagram.

FIG. 12 shows a power supply circuit, in which a condenser motor 42 is composed of the already described operation condenser 41 and two coils 184 and 185 being associated in parallel, and, the electromagnet 67 is joined in parallel with the condenser 41.

The power switch 186 performs the switching operation of the normal-reverse turn of the condenser motor 42, besides the ON-OFF operation of the power supply.

Further, the limit switches 174, 174 are composed of normally open contacts and are normally made on by switch levers 166, 166.

With this power supply circuit, as the power switch 186 is made on at its normal or reverse position, the condenser motor 42 is driven to make normal or reverse turn through the limit switch 174 and when the limit switch 174 is made off, the condenser motor 42 is stopped.

SUMMARY DESCRIPTION

The operation of the blind 11 take-up device 10 composed as hereabove described is explained hereunder:

The first work to be done after the take-up device 10 composed as hereabove described has been installed by a window is to preset the stop positions of the blind, which is conducted by the positioning mechanism 16.

For example, the presetting operation of the bottom position of the blind 11 to be conducted when unrolling it is described:

First, by pulling up the operation piece 159 on the side of the lower limit stop mechanism 134, the counter 143 on the side of the lower limit stop mechanism 134 is set and, then, by this operation, the protrusion 171 of the rotor 168 of the switch lever 166 is brought opposite to the recess 163 of the highest place counter wheel 142, whereby the presetting counting value for the counter 143 is preset.

Under the normal condition, as the protrusion 171 of the rotor 168 comes into engagement with the recess 163 of the counter wheel 142, the limit switch 174 is made off; however, due to the oscillation of the oscillating frame 147 caused by the setting operation, the switch lever 166 is depressed, whereby the limit switch 174 is made on.

Then as the power switch 186 is operated in the direction of unrolling the blind 11, for example, it is made on on the normal turn side, the condenser motor 42 in the drive 13 makes normal turn and coincidentally therewith, the electromagnet 67 is made on; accordingly, the output from the condenser motor 42 drives the take-up shaft 12 in the direction of unrolling the blind through the motor side reduction mechanism 15.

By the above-described operation, the blind 11 is unrolled. Then as this blind has been unrolled to the desired position, the setting operation of the counter 143 is stopped by depressing the operation piece 159.

By this operation, the depression of the switch lever 166 is released and, moreover, the protrusion of 171 of the rotor 168 has already been brought opposite to the recess 163 of the counter wheel 142; therefore, the switch lever 166 moves up, causing the limit switch 174 to be made off, and as a consequence, the condenser motor 42 stopped. Further, the electromagnet 67 is also made off; consequently, the braking mechanism 14 locks the motor output and the unrolling of the blind 11 is stopped at the desired position, thereby accomplishing the setting of the lower limit stop position of the blind 11.

The setting operation for the upper limit stop position of the blind 11 may be performed similarly with the upper limit stop mechanism 133.

Once the stop positions for unrolling and taking-up of the blind 11 have been set as hereabove-described, the operation thereafter for unrolling or taking-up will be performed by the normal or reverse operation of the power switch 186.

In stopping the normally used blind 11, as the counter 143 counts the preset counting value, the protrusion 171 of the rotor 168 engagingly enters the recess 163 of the highest place counter wheel 142; then, the switch lever 166 goes up, causing the limit switch 174 to be made off, and thereby the condenser motor 42 stopped; consequently, the blind 11 is stopped at the preset unrolled or taken-up position.

The manual unrolling or taking-up of the above-mentioned blind 11 is performed by turning the rope 17 in the normal or reverse direction.

By this operation, the manual shaft 118 is turned; this rotation is reduced in speed by the manual side reduction mechanism 18, and the reduced output transmitted to the take-up shaft 12, to turn it, thereby causing the blind 11 to be unrolled or taken up.

While in the above-mentioned embodiment of this invention, a taking-up device 10 for blind 11 has been described, this invention is also applicable as taking-up devices for various other types of screens such as curtains, weighing shutters, tents, projecting screens, etc.

What is claimed is:

1. A screen taking-up device equipped with:

a normal-reverse turn motor of outer-rotor type which is contained in a cylindrical take-up shaft, a motor side reduction mechanism which reduces in speed the output from the aforementioned motor by a planetary gear reduction mechanism and transmits this reduced output to the take-up shaft, a braking mechanism for applying brake on the inertial output of this motor in sync with the time when the aformentioned motor is controlled to stop, a manual shaft for delivering manual normal-reverse rotation, a manual side reduction mechanism for reducing in speed the output from this manual shaft by a planetary gear reduction mechanism and transmitting this reduced output to the aforementioned motor side reduction mechanism, a self-locking mechanism interposed between the aforementioned two reduction mechanisms on the motor and the manual sides for transmitting the normal-reverse rotation from the manual shaft to the motor side reduction mechanism, and a positioning control mechanism for counting the number of revolutions of the take-up shaft with a counter and controlling the drive of the motor to stop at the preset number of revolutions.

2. The device of claim 1, wherein said braking mechanism comprises a permanent magnet formed annular in shape and having a specified magnetic force is fixed on a support member interlocked with the rotation of the motor, an electromagnet which produces a large magnetic force than the aforementioned permanent magnet does is placed opposite to the permanent magnet at a specified distance therefrom, between the permanent magnet and the electromagnet, an annular brake plate is interposed movably in the respective facing directions, said brake plate being interlocked with the rotation of the take-up shaft.

3. The device of claim 1, wherein said self-locking mechanism comprises a semicircular ring on the output side interlocked with the manual shaft which is subject to manual normal-reverse rotation and a semicircular ring on the input side coupled with the reduction output on the motor side are faced to each other on a common circle and housed in a cylindrical cavity of the casing which is in stationary state, with a specified gap formed between the facing end surfaces, a locking spring formed in a coil shape is housed inside the aforementioned cylindrical cavity in a state of being in contact under pressure with its inner peripheral surface, two end protrusions of this locking spring are inserted in the gap between the aforementioned two semicircular rings, the inserting directions of said protrusions being so set that the OD of the locking spring will be reduced as the output side semicircular ring applies a turning force on the protrusion.

4. The device of claim 1, wherein said positioning mechanism comprises an input gear is cut on the inside wall surface of an annular body which is interlocked with the take-up shaft, on the input side of a counter equipped with a plurality of counter wheels, an input gear which meshes with the aforementioned output gear is provided, a recess is formed in the peripheral surface of the highest place counter wheel of the aforementioned counter, a switch lever pivotally mounted on the support frame at its root end is placed opposite and in the state of being urged toward the aforementioned highest place counter wheel, on this switche lever, there is provided a rotor which forces the switch lever to move, as it enters into the recess of the aforementioned counter wheel in engagement therewith, and a switch for controlling the motor to stop is installed opposite the aforementioned switch lever.

5. A screen taking-up device as claimed in claim 4 characterized in that:

the recess of the aforementioned highest place counter wheel is formed with a gradually sloped surface on the upward turning direction for making the counting and with a vertical surface coinciding with its radial direction, respectively, the aforementioned rotor is rotatably supported on a shaft, on its surface, a circular surface and a protrusion projecting from this circular surface is formed, the amount of projection of this protrusion is set shorter than the depth of the recess of the aforementioned counter wheel, and the protrusion of the aforementioned rotor is urged toward the side where it faces and in contact with the counter wheel.

* * * * *